United States Patent [19]

Kaye et al.

[11] Patent Number: 4,677,782

[45] Date of Patent: Jul. 7, 1987

[54] POSITION ACTUATED ILLUMINATED GUNSIGHT

[75] Inventors: Gordon E. Kaye, Garrison; Joseph A. Agnello, Jr., Peekskill, both of N.Y.

[73] Assignee: Univention Inc., Garrison, N.Y. ; a part interest

[21] Appl. No.: 747,354

[22] Filed: Jun. 21, 1985

Related U.S. Application Data

[63] Continuation-in-part of Ser. No. 451,476, Dec. 20, 1982, Pat. No. 4,524,534.

[51] Int. Cl.[4] ..... F41G 1/32

[52] U.S. Cl. ..... 42/100; 33/241

[58] Field of Search ..... 42/1.5, 1 A; 33/241, 33/252; 362/110, 111, 112, 800, 802

[56] References Cited

U.S. PATENT DOCUMENTS

| | | | |
|---|---|---|---|
| 497,540 | 5/1893 | Garassino et al. | 33/241 |
| 953,426 | 3/1910 | Mills | 33/241 |
| 1,743,906 | 1/1930 | Valeriano | 33/241 |
| 3,916,530 | 11/1975 | Tellie | 33/241 |
| 4,524,534 | 6/1985 | Kaye et al. | 42/1.5 |

FOREIGN PATENT DOCUMENTS

| | | | |
|---|---|---|---|
| 2481435 | 10/1981 | France | 42/1.5 |
| 8751 | of 1910 | United Kingdom | 42/1 A |
| 1008009 | 10/1965 | United Kingdom | 33/241 |

*Primary Examiner*—Deborah L. Kyle
*Assistant Examiner*—Michael J. Carone
*Attorney, Agent, or Firm*—Israel Nissenbaum

[57] ABSTRACT

An illuminated gunsight adapted to be fixedly engageable with a firearm having existing sighting means. The illuminated gunsight comprises a base member which is fixedly anchored to the barrel of a firearm, or to the existing sighting means or to both the barrel and the existing sighting means. A second member, containing illumination means, such as a light emitting diode (LED), is moveably affixed to the base member. Movement of the LED containing member relative to the anchored base member, into and out of sighting alignment with the existing sighting means provides the electrical activation and deactivation of the LED.

12 Claims, 9 Drawing Figures

POSITION ACTUATED ILLUMINATED GUNSIGHT

This is a continuation-in-part of U.S. Ser. No. 451,476 filed Dec. 20, 1982 and now U.S. Pat. No. 4,524,534.

This invention relates to illuminated gunsights and particularly to electrically operated gunsights utilized for providing a pinpoint of light in illuminating the end of a firearm or other sighting means of the firearm for aiming under low light level condition.

Electrically operated illuminated gunsights such as described in U.S. Pat. Nos. 3,914,873 and 3,994,072 have either been physically incorporated into the firearm such as by permanent positioning thereon with internal (relative to the firearm) wiring to an actuating switch also integrated with the firearm or, alternatively, such illuminated gunsights have been of an "add-on" nature and have generally been affixed to the barrel of the firearm. On some firearms, however, because of the configuration of the existing sighting means, such as those which provide a framing sight for a target, it is highly desirable that such illuminated gunsights be easily removable for use of the firearm during daylight hours or under conditions of sufficient light levels. Such removal is desirable since the illumination itself and the body or bulk of the illuminated gunsight may in fact be a hindrance for proper aiming and sighting under proper lighting conditions. In order to effect such removal, "add-on" illuminated gunsights were generally required to be totally disengaged from the firearm with built-in illuminated gunsights not even providing for such option if desired.

In U.S. Pat. No. 497,540, an illuminated gunsight is described wherein a mercury switch is utilized whereby movement of the gun barrel into a horizontal firing position activates the electrically powered gunsight and movement of the barrel such as into a vertical non-firing position switches off the gunsight. However, the sight is constantly on the gun and impedes viewing of the forward existing sight of the gun during daylight. Such sight is thus adapted to be removed from the gun during non-use.

In addition to the necessity for total removal of the illuminated gunsights, the actual usage of such gunsights provided some difficulties since the "add-on" gunsights were generally cumbersome and obtrusive. Furthermore, in some applications, such as with an M-16 rifle having a target framing sighting means, such prior art illuminated gunsights could not be readily or effectively utilized therewith. Firearms such as the M-16 rifle utilize extending elevated sights thereby rendering ineffectual prior art illuminated gunsights which were generally adapted to be affixed to the barrel of the firearm.

It is an object of the present ivnention to provide an illuminated gunsight for fixed engagement with a firearm wherein the normal sighting means of the firearm may be utilized, when desired, without impedance from the gunsight and without the necessity for the removal thereof from the firearm.

It is a further object of the present invention to provide such illuminated gunsight whereby it may be operably mounted upon the existing sight of a firearm.

These and other objects, features and advantages of the present invention will become more evident from the following discussion as well as the drawings in which.

Figure 1:
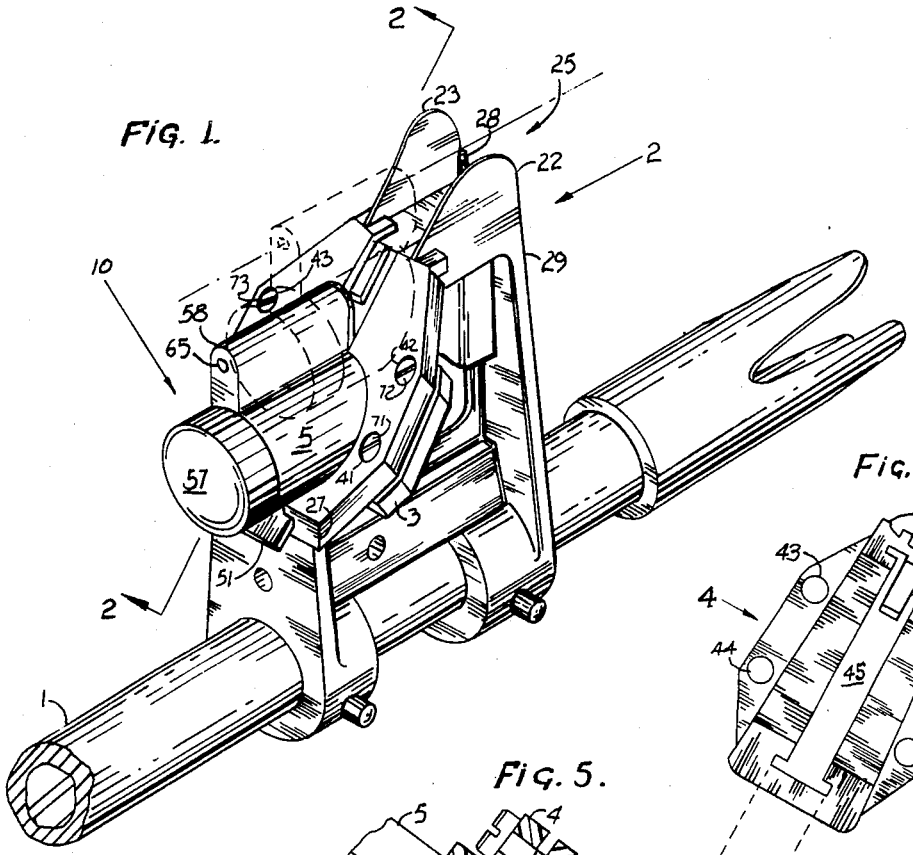
FIG. 1 is an isometric view of the illuminated gunsight of the present invention positioned on the sight of an M-16 rifle.

Generally the present invention comprises an illuminated gunsight for a firearm which aids in the visual perception of the existing sighting means of the firearm under conditions of low ambient light. Such illuminated gunsight is useful in limning the target itself relative to the existing firearm sight for enhanced aiming under such low light conditions.

The illuminated gunsight of the present invention comprises electrically powered illumination means, a base member adapted to be affixed to the firearm and/or firearm sight and anchoring means for affixing the gunsight to the firearm itself, or to an existing sight on said firearm such as the elevated ramp sight utilized with M-16 rifles.

The illumination means is electrically powered and is moveably affixed to the base member whereby it is moveable relative to both the sighting means of the firearm and the base member anchored to the firearm. An illuminated point of reference is lit when desired, by such movement to enable the shooter to readily and properly align the existing sighting means of the firearm with a target under low lighting conditions. The moveable illumination means is manually moved into position for such proper aiming alignment and removed from such position, when not desired, with such movement being effected without movement of the anchored base member or removal of the gunsight from its fixed position on the firearm.

The illuminated gunsight further comprises position actuating means for electrically powering said illumination means when the illumination means is in position for sighting therewith. Under conditions of sufficient light for sighting such as in daylight, when the illumination and the illumination means are unnecessary, or in fact a hindrance for proper sighting, means are provided for deactivation of the illumination and the removal of the illumination means from the sighting position, without the necessity for movement of the anchored base member or removal of the gunsight from the firearm.

The illumination means, such as a light emitting diode (LED) is powered by a power supply such as an electric cell or battery (hereinafter referred to as 'battery') generally contained within said gunsight. The position actuating means causes the completion of an electrical circuit between the battery and the LED when the LED is in sighting alignment for proper aiming at low light levels. For example, the position actuating means may comprise a moveable member which forces an electrical connector into contact with the battery for completion of an electrical circuit. Alternatively, the illumination means and/or connections thereof may be moved into direct engagement with the battery during the movement required to properly position said illumination means.

In a preferred embodiment of the present invention, the position activated illuminated gunsight is adapted for use with an M-16 rifle having a substantially elevated ramped sighting member with such illuminated gunsight being fixedly positioned and seated on said existing M-16 sight, and being position activated by movement of the illumination means relative to said existing sight.

The illuminated gunsight, adapted for use with the M-16 rifle, comprises three elements, a clamping base element for anchoring the gunsight on the M-16 sight, a slide platform fixed into position on said M-16 sight by engagement with said clamping element, and an illumination member, with contained power supply and illumination means, which is moveably slideable in relation to said slide platform and said existing sight.

The clamping base element and the slide platform form the anchored base member by sandwiching the ramp of an M-16 rifle sight therebetween and are fixedly held in position by holding means such as connecting screws or bolts. The slide platform overlaps and fixedly engages the ends of the ramp portion of an M-16 rifle sight for positive non-moveable engagement therewith thereby setting a frame of reference for positioning said gunsight for movement of the illumination member, with contained illumination means, into proper illumination position with the existing sight with the simultaneous electrical actuation caused by such positioning. Sliding of the illumination member into sighting position causes completion of an electrical circuit with a contained power supply to activate the illumination means thereof.

An alternative structure such as with a vertical firearm sighting member comprises an anchoring base member affixed to the sight (less preferred but still useful is a base member affixed to the barrel of the firearm). Instead of a sliding actuating movement, the illumination member is rotatably moveable along a pivot on the base member with the illumination means such as the LED being rotated into sighting alignment with the existing sight of the firearm. Electrical activation and deactivation of the LED occurs upon such movement into and out of sighting alignment respectively.

Figure 5:
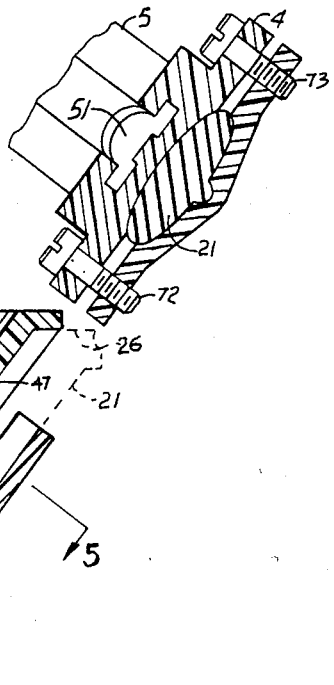
FIG. 5 is a partial section view taken along line 5—5 of FIG. 2.
Figure 2:
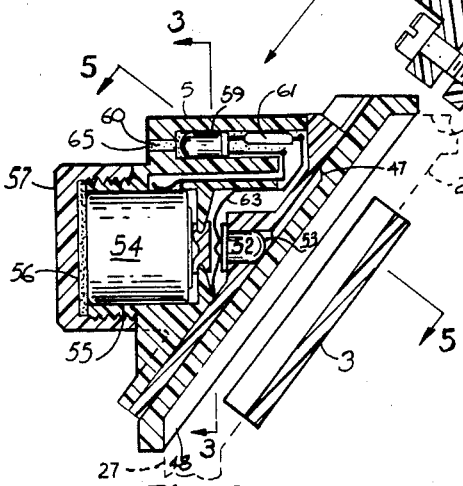
FIG. 2 is a section view taken along line 2—2 of FIG. 1.
Figure 3:
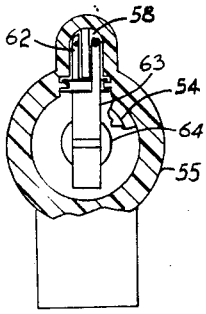
FIG. 3 is a partial section view taken along line 3—3 of FIG. 2.

With specific reference to the drawings, FIGS. 1, 2 and 5 depict the illuminated gunsight 10 of the present invention positioned on a ramped sight 2 located on barrel 1 of an M-16 rifle. The standard M-16 rifle sight 2 comprises an open right triangle shaped member 29 fixed at the base thereof to said rifle barrel 1. The ramp section 21 of said triangle member 29 faces the shooter and terminates, at it upper end with wing sections 22 and 23 which serve to frame a target within area 25 and into alignment with target pin 28 for proper sighting and aiming during shooting. Illuminated gunsight 10 is positioned on said ramp section 21 with sliding illumination member 5 being moveable as shown by the dotted lines such that the illuminating means, light emitting diode (LED) 59, is moved into proper alignment with said target framing area 25 and target pin 28 for low light level shooting. Slide platform 4 and clamping base plate 3, lock the gunsight 10 into position by sandwiching ramp section 21 therebetween with holding screws 71–74. Said screws pass through apertures 41–44 respectivley in slide platform 4, and are engaged in aligned, adjacent threaded holes in clamping base plate 3. As is more evident in FIG. 5, both the base plate 3 and slide platform 4, are shaped to specifically accommodate ramp section 21 therebetween to provide a positive frictional grip.

Figure 4:
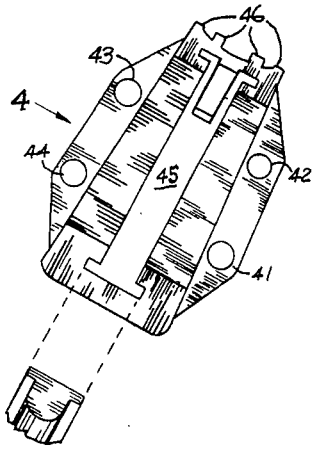
FIG. 4 is a plan separated view of the co-fitting sighting element and the sliding platform element into which it is moveably mounted.

Slide platform 4, as seen in FIG. 1, 2 and 4 has finger sections 46 to fixedly engage wing sections 22 and 23 of sight 2 for effecting a positive stop in the upward direction for said slide platform 4. Finger sections 46 rest upon upper platform 26 of sight 2 thereby fixedly providing a positive frame of reference for movement of illumination member 5 into proper sighting and simultaneous actuating position. At its lower periphery, slide platform 4 engages lower wall 27 of sight 2. Skirt section 48 fits onto ramp 21 to complete the fixed engagement of slide platform 4 relative to ramp section 21 and sight 2 thereby preventing movement of the slide platform 4 during the positioning movement of the illumination member 5.

Slide platform 4 contains a "T" slot 45 as shown in FIG. 4 which is adapted to be engaged with "T" shaped member 51 of the sliding illumination member 5. Such engagement permits relative movement of illumination member 5 and slide platform 4 for both positioning of the illuminating diode 59 for proper low light aiming and the simultaneous electrical actuation thereof by such movement.

The electrical circuitry, illumination means and actuating means for the illuminated gunsight 10 are contained within sliding illumination member 5. As shown in FIG. 2, light emitting diode (LED) 59 is contained within chamber 58 such that light from the LED is visible through opening 60. Reduction of glare from the LED 59 is effected by connecting the LED 59 to a voltage dropping resistor 61 and by narrowing aperture or opening 60. The LED 59 and resistor 61, which may be integrated with the LED, are encapsulated within an encapsulating material such as a transparent epoxy 65 which protects the LED 59 and resistor 61 from both shock and moisture while permitting light from the LED to be seen through aperture 60 when the LED 59 is in alignment with target sighting pin 28. LED 59 is electrically powered by battery 54 which is contained within battery compartment 55 and sealed therein by threaded cap 57 and watertight resilient gasket 56. Terminal lead tab 62 electrically connects LED 59 to a terminal of battery 54. During activation of the LED 59, lead tab 63, made of resilient leaf spring material, serves to complete the circuit for powering LED 59 for illumination via metal contact to rivet 64 which is in turn in contact with the other terminal of battery 54. Lead tab 63 is normally, however, resiliently biased against making contact with metal rivet 64 and is in spring contact with activation pin 52 seated in aperture 53 in the base of illumination member 5.

Electrical activation of LED 59, by means of positioning movement, is effected by the upward sliding movement of "T" shaped sliding member 51, of illumination member 5, within accomodating "T" slot 45 in slide platform 4 to the position shown in dotted lines in FIG. 1. In such position, pin 52 will have moved up ramp 47 in slide platform 4 whereby such pin 52 is thereby moved toward battery 54 thereby causing tab 63 to electrically engage rivet 64 and battery 54 to complete the circuit thereby lighting up LED 59. Thus only when the LED 59 is in proper sighting position in alignment with target sighting pin 28 is such LED 59 illuminated. Deactivation of LED 59 is effected by downward sliding movement of illumination member 5, with the riding down of pin 52 off ramp 47 with the consequent release and spring movement of tab 63 from electrical contact with rivet 64 and battery 54. Thus, when not desired, illumination is shut off and the illumination member is removed from the sighting area without removal of the entire gunsight.

Figure 8:
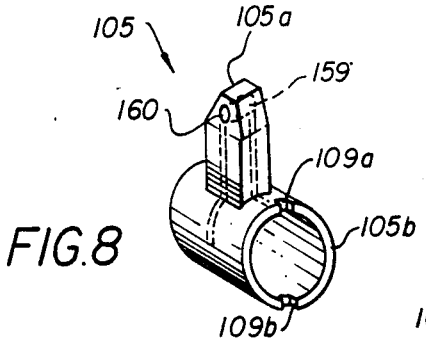
FIG. 8 is an isometric view of the illumination member of FIG. 7.
Figure 7:
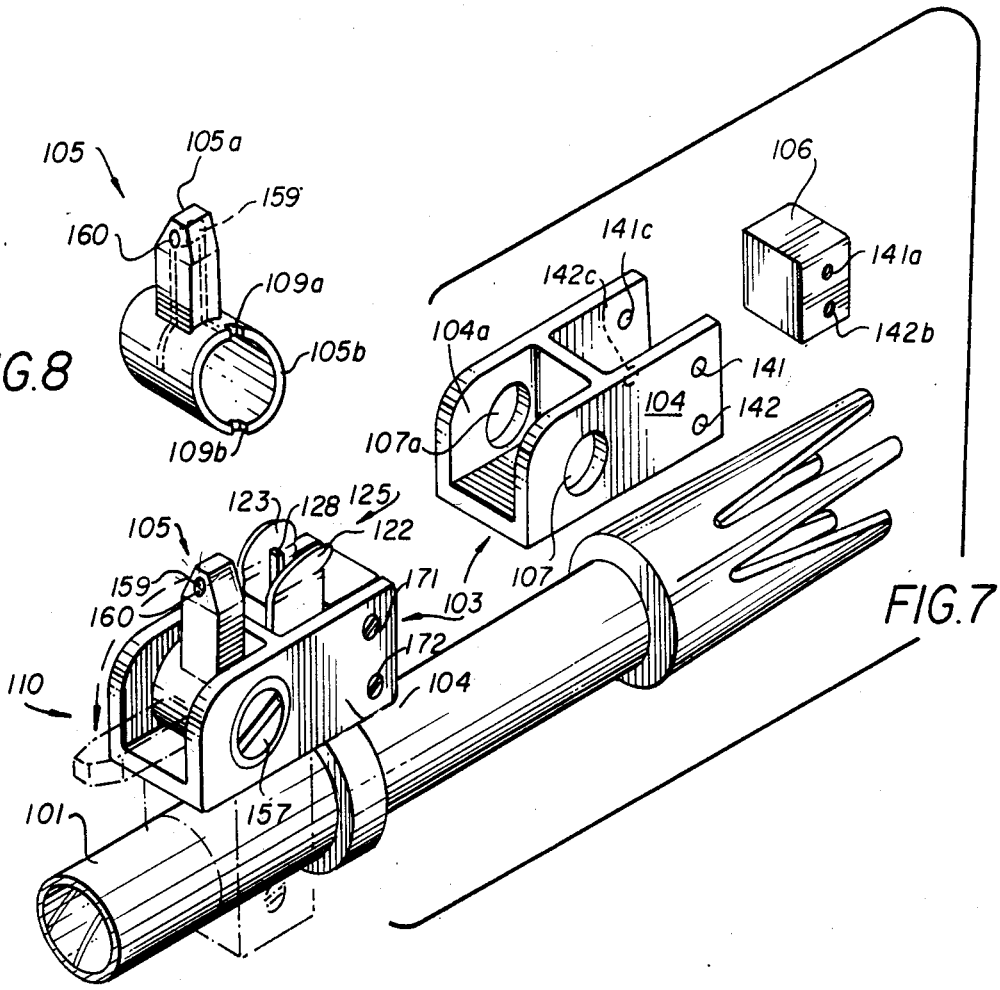
FIG. 7 is the sight and firearm of FIG. 6 with another embodiment of the illuminated gunsight of the present invention operably seated thereon and an exploded view of the base member with anchoring means.
Figure 9:
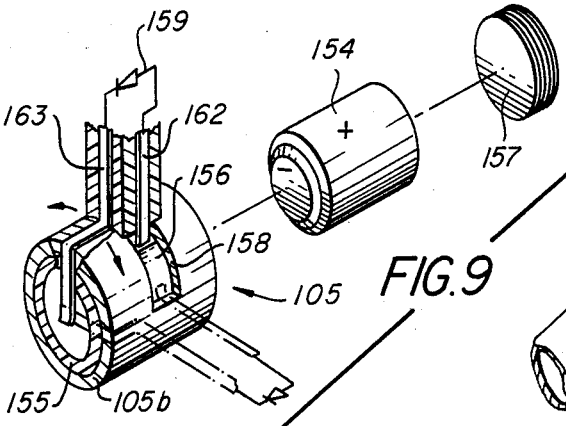
FIG. 9 is a partial exploded and partial sectioned schematic internal view of the electrical activation means of the sight of FIG. 7.
Figure 6:
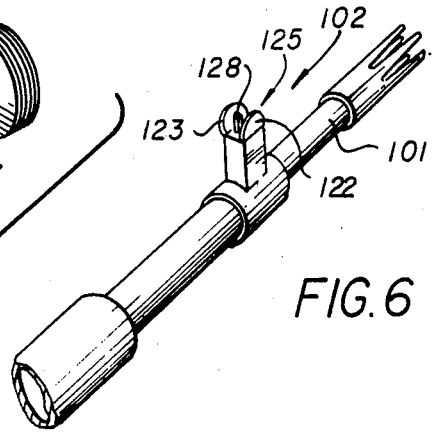
FIG. 6 is an isometric view of a firearm having a vertical front sight.

In another embodiment of the present invention as shown in FIGS. 6–9 illuminated gunsight 110 is affixed to existing vertical firearm sight 102 by anchoring clamp member 103 of gunsight base member 104. Alternatively, as shown by the dotted lines, the illuminated gunsight 110 may be clamped directly to the barrel 101 of the firearm or a combination of clamps 103 may be used to clamp the illuminated gunsight 110 to both the barrel 101 and the existing sight 102. Illuminated gunsight 110, as shown in FIG. 7, comprises the "U" shaped clamping member 103 which is sized to be fittingly placed on sight 102 (alternatively it may be sized to fit on the barrel 101) until the sight 102 is abutted against cross section 108 of base member 104. Block 106 with screw apertures 141*a* and 142*b* snugly encloses the sight 102 at the open end of "U" shaped clamp member 103. Anchoring of base member 104 to sight 102 is completed by screws 171 and 172 which pass through apertures 141 and 142 of clamp member 103 and apertures 141*a* and 142*b* of block 106 respectively into engagement with threaded holes 141*c* and 142*c* respectively to effect the requisite anchoring. With such anchoring, gunsight base member 104 is anchored to the firearm in a position whereby light emitting diode (LED) 159, contained within illumination member 105 is moveable into direct alignment with sighting pin 128 contained within sighting frame area 125, formed between wing sections 122 and 123 of vertical sight 102. Illumination member 105 is comprised of diode containing section 105*a* having aperture 160 through which the diode is visible to the rear of the firearm. Section 105*b* of the illumination member 105 is a hollow tubular pivotal section integrated with section 105*a*. As seen in FIGS. 8 and 9, LED 159, within section 105*a*, is connected to conductive tab members 162 and 163 which are in electrical contact with the terminal portions of battery 154.

In assembling illuminated gunsight 110 for utilization, hollow tubular section 105*b* of the illumination member 105 is seated within cavity 104*a* of base member 104 with the open ends thereof being concentrically disposed around aperture 107 and depression 107*a*. Detents 109*a* and 109*b* of section 105*b* fit within corresponding depressions (not shown) in the internal wall section of cavity 104*a* to properly locate section 105*b*. Thereafter, battery 154, within tubular battery casing 155, is in turn inserted through aperture 107 in base member 104 and snugly placed through hollow tubular section 105*b* of illumination member 105 whereby said illumination member 105 is rotatably pivotable around said battery casing 155. The open end of battery casing 155 is abutted against depression area 107*a* and locked therein by means of threaded closure member 157. Both battery 154 and casing 155 are thereby rigidly locked into non-moving position. Resilient conductive tab member 163, insulatively passes through the wall of section 105*b* and is resiliently biased against the end terminal of battery 154. Resilient conductive tab member 162 passes through coextensive side notches 158 and 158*a* of section 105*b* and the battery casing 155 respectively whereby it contacts exposed terminal of battery 154 of opposite polarity to complete the electrical circuitry and activation of LED 159. Insulative member 156 positioned within notches 158 and 158*a* directly adjacent the exposed battery terminal prevents electrical contact between tab member 162 and battery 154 except when illumination member 105 is in the upright position with LED 159 being in alignment with sighting pin 128. Rotation of illumination member out of such alignment, as shown by the dotted lines of FIGS. 7 and 9, thereby breaks the circuit and shuts off LED 159. Detents 109*a* and 109*b* click into position to hold the illumination member 105 in the proper activation and deactivation positions respectively.

The material comprising the illuminated gunsight of the present invention should be resistant to shock, vibration, humidity and varying temperature changes. An exemplary material suitable for such usage is polycarbonate. Similarly, the illumination means is a shock resistant diode which is also preferred over other lighting means such as incandescent bulbs because of its low power consumption. Nevertheless other sighting means, if properly protected, may be utilized in place of the diode.

The battery is preferably a lithium battery because of its high capacity in a limited space, long storage life, and its good performance over a wide temperature range.

It is understood that the above description and drawings are illustrative of the present invention and are not to be construed as limitations on the present invention. Thus, depending upon the configuration and operation of particular firearms, other modifications of the position actuated illuminated gunsight of the present invention are possible. Changes may similarly be made such as in the configuration and means for providing the activation movement and the activation without departing from the scope of the present invention as defined by the following claims.

We claim:

1. An illuminated gunsight for a firearm having a receiver, a barrel and existing sighting means comprising a front sight, said illuminated gunsight comprising a base member and an illumination member moveably affixed to said base member, said illuminated gunsight further comprising means for fixedly anchoring said base member onto said firearm, electrically activated illumination means affixed to said illumination member, and activating means for electrically activating said illumination means, wherein said illumination member, when moved relative to said fixedly anchored base member bringing said illumination means into sighting alignment with said sighting means of said firearm, electrically activates said illumination means thereby, and wherein movement of said illumination member, relative to said fixedly anchored base member, bringing said illumination means out of said sighting alignment, electrically deactivates said illumination means.

2. The illuminated gunsight of claim 1 wherein said anchoring means comprises a clamping member conformed to the shape of said existing sighting means.

3. The illuminated gunsight of claim 1 wherein said moveable electrically activated illumination means comprises a light emitting diode (LED) fixedly seated within a member slideably moveable relative to said fixedly anchored base member.

4. The illuminated gunsight of claim 1 wherein said moveable electrically activated illumination means comprises a light emitting diode (LED) fixedly seated within a member rotatably moveable relative to said fixedly anchored base member.

5. The illuminated gunsight of claim 1 wherein said gunsight contains an electrical power source for said illumination means wherein an electrical circuit connection is completed by movement of said illumination means into said sighting alignment.

6. The illuminated gunsight of claim 5 wherein said electrical power source is a battery.

7. The illuminated gunsight of claim 6 wherein said illumination means is electrically connected to one terminal of said battery with said illumination means being electrically connected to a conductive element spaced from the other terminal of said battery with said activating means comprising a moveable member which forces said conductive member into electrical engagement with said other terminal with movement of said illumination means into said sighting alignment.

8. The illuminated gunsight of claim 6 wherein said illumination means is electrically connected to one terminal of said battery with said illumination means being electrically connected to a conductive element spaced from the other terminal of said battery and means whereby movement of said illumination means into said sighting alignment causes said conductive element to be brought into contact with said other terminal of said battery to complete an electrical circuit thereby activating said illumination means.

9. The illuminated gunsight of claim 1 wherein said existing sighting means comprises an elevated sight with a target framing area with said illuminated gunsight being anchored to said elevated sight and wherein said illumination means is electrically activated by movement thereof into alignment with said target framing area.

10. The illuminated gunsight of claim 9 wherein said existing sighting means of said firearm is a ramped sight and said activation movement is a sliding movement relative to said sighting means.

11. The illuminated gunsight of claim 9 wherein said existing sighting means of said firearm is a vertical sight and said activation movement is a rotational movement relative to said sighting means.

12. An illuminated gunsight for a firearm, having existing sighting means, comprising a base member, affixed to said sighting means by an anchoring clamp member, and an illumination member having illumination means contained therein, said illumination member having a tubular section thereof rotatably affixed to a battery fixedly anchored to said base member, said battery being contained within an insulative casing therefor, wherein said illumination means is electrically connected to an end terminal of said battery and wherein a conductive member is affixed to said illumination means, with said conductive member being in contact with another terminal of said battery when said illumination means is in alignment with said existing sighting means thereby activating said illumination means and wherein an insulation member is positioned between said conductive member and said battery when said illumination means is out of alignment with said existing sighting means thereby deactivating said illumination means.

* * * * *